US008657970B2

(12) United States Patent
Yoshinaga et al.

(10) Patent No.: US 8,657,970 B2
(45) Date of Patent: Feb. 25, 2014

(54) HOT-ROLLED STEEL SHEET EXCELLENT IN FATIGUE PROPERTIES AND STRETCH-FLANGE FORMABILITY AND METHOD FOR MANUFACTURING THE SAME

(75) Inventors: Naoki Yoshinaga, Tokyo (JP); Masafumi Azuma, Tokyo (JP); Yasuharu Sakuma, Tokyo (JP); Naoki Maruyama, Tokyo (JP)

(73) Assignee: Nippon Steel & Sumitomo Metal Corporation, Tokyo (JP)

( * ) Notice: Subject to any disclaimer, the term of this patent is extended or adjusted under 35 U.S.C. 154(b) by 213 days.

(21) Appl. No.: 12/934,039

(22) PCT Filed: Nov. 12, 2008

(86) PCT No.: PCT/JP2008/070612

§ 371 (c)(1),
(2), (4) Date: Sep. 22, 2010

(87) PCT Pub. No.: WO2009/118945

PCT Pub. Date: Oct. 1, 2009

(65) Prior Publication Data

US 2011/0017360 A1 Jan. 27, 2011

(30) Foreign Application Priority Data

Mar. 26, 2008 (JP) ..... 2008-079591

(51) Int. Cl.

| | |
|---|---|
| ***C22C 38/00*** | (2006.01) |
| ***C22C 38/08*** | (2006.01) |
| ***C21D 8/02*** | (2006.01) |
| ***C22C 38/14*** | (2006.01) |

(52) U.S. Cl.
USPC ..... 148/320; 148/332; 148/336; 148/602; 420/126

(58) Field of Classification Search
USPC ..... 148/320, 328, 516, 602, 332, 336; 420/120, 126
See application file for complete search history.

(56) References Cited

U.S. PATENT DOCUMENTS

| | | | | |
|---|---|---|---|---|
| 6,632,295 | B2 * | 10/2003 | Nakata et al. | 148/320 |
| 6,676,774 | B2 * | 1/2004 | Matsuoka et al. | 148/328 |

FOREIGN PATENT DOCUMENTS

| | | | |
|---|---|---|---|
| EP | 1 607 489 | A1 | 12/2005 |
| EP | 1 669 470 | A1 | 6/2006 |
| EP | 1 865 083 | A1 | 12/2007 |
| JP | 59-1632 | A | 1/1984 |
| JP | 61-130454 | A | 6/1986 |
| JP | 6-200351 | A | 7/1994 |
| JP | 7-11382 | A1 | 1/1995 |
| JP | 8-269617 | A | 10/1996 |
| JP | 2000-144259 | A | 5/2000 |
| JP | 2000-169935 | A | 6/2000 |
| JP | 2000-169936 | A | 6/2000 |
| JP | 2000328186 | A * | 11/2000 |
| JP | 2004-131802 | A | 4/2004 |
| JP | 2005-82841 | A | 3/2005 |
| JP | 2005-248240 | A | 9/2005 |
| JP | 2006-274317 | A | 10/2006 |

OTHER PUBLICATIONS

Benscoter et al., ASM Handbook-Metallography and Microstructures of Low-Carbon and Coated Steels, 2004, ASM International, vol. 9, p. 1-4.*

Ginzburg, Vladimir, Metallurgical Design of Flat Rolled Steels-Heat Transfer in Hot Rolling of Flat Products, 2005, Mareel Dekker, p. 229.*

Guthrie et al., ASM Handbook-Processing of Solid Steel-Hot Rolling, 1990, ASM International, vol. 1, (p. 107-125), p. 1-13 of 13.*

Bramfitt, B.L., ASM Handbook-Annealing of Steel-Annealing of Sheet and Strip, 1991, ASM International, vol. 4, (p. 42-55), p. 1-6 of 6.*

Langill, T.J., ASM Handbook-Batch Process Hot Dip Galvanizing-Galvanizing, 2003, ASM International, vol. 13A, (p. 794-802), p. 1 of 1.*

Hashimoto et al., English machine translation of JP 2000-328186, Nov. 2000, p. 1-10.*

Office Action in Canadian Application No. 2,718,098 mailed Jun. 6, 2011.

"Recent Research on the Bainite Microstructure of Low Carbon Steel and its Transformation Behavior-Final Report of the Bainite Research Committee", edited by the Bainite Investigation and Research Committee of the Basic Research Group of the Iron and Steel Institute of Japan, The Iron and Steel Institute of Japan, (1994) pp. 1-8, and 125-127.

International Search Report dated Feb. 24, 2009 in International Application No. PCT/JP2008/070612.

"Metal Material Fatigue Design Handbook," Society of Materials Science, Japan, 2nd Ed., pp. 84-87, including the cover sheet, first page, last page and a partial English translation. (1981).

Extended European Search Report dated Dec. 27, 2011 for Application No. 08873613.7.

* cited by examiner

*Primary Examiner* — Roy King
*Assistant Examiner* — Caitlin Kiechle
(74) *Attorney, Agent, or Firm* — Birch, Stewart, Kolasch & Birch, LLP

(57) ABSTRACT

This hot-rolled steel sheet contains, in terms of mass %, C: 0.015% or more to less than 0.040%; Si: less than 0.05%; Mn: 0.9% or more to 1.8% or less; P: less than 0.02%; S: less than 0.01%; Al: less than 0.1%; N: less than 0.006%; and Ti: 0.05% or more to less than 0.11%, with the remainder being Fe and inevitable impurities, wherein Ti/C is in a range of 2.5 or more to less than 3.5, Nb, Zr, V, Cr, Mo, B and W are not included, a microstructure includes a mixed microstructure of polygonal ferrite and quasi-polygonal ferrite in a proportion of greater than 96%, a maximum tensile strength is 520 MPa or more and less than 720 MPa, an aging index AI is more than 15 MPa, a product of a hole expansion ratio (λ) % and a total elongation (El) % is 2350 or more, and a fatigue limit is 200 MPa or more.

9 Claims, 3 Drawing Sheets

NORMAL FRACTURE SURFACE
(DUCTILE FRACTURE SURFACE)

NORMAL FRACTURE
SURFACE+ABNORMAL
FRACTURE SURFACE
(BRITTLE FRACTURE SURFACE)

HOT-ROLLED STEEL SHEET EXCELLENT IN FATIGUE PROPERTIES AND STRETCH-FLANGE FORMABILITY AND METHOD FOR MANUFACTURING THE SAME

TECHNICAL FIELD

The present invention relates to a hot-rolled steel sheet excellent in fatigue properties and stretch-flange formability, and a method for manufacturing the same. In particular, the present invention relates to a hot-rolled steel sheet which has an uniform microstructure contributing to excellent stretch-flange formability and which can be easily formed into a component under conditions where a strict stretch flange processing is required, and a method of manufacturing the same.

The present application claims priority on Japanese Patent Application No. 2008-079591, filed on Mar. 26, 2008, the content of which is incorporated herein by reference.

BACKGROUND ART

In recent years, a high-strength steel sheet or light metal such as Al alloy has been applied to vehicle members for the purpose of weight decrease for improving vehicle fuel efficiency and the like. The light metal such as Al alloy has an advantage in that specific strength is high; however, it is much more expensive than a steel, and therefore, the application of the light metal is limited to special uses. Accordingly, it is necessary to realize a steel sheet having higher strength in order to promote weight decrease of vehicles over a wide range and at a lower cost.

In general, the increase in strength of a material causes material characteristics such as formability (workability) to deteriorate. Therefore, it is important to achieve the increase in strength without the deterioration in the material characteristics for developing a high-strength steel sheet. Particularly, as characteristics which are required for steel sheets used for inner plate members, structural members and underbody members, stretch-flange formability, ductility, fatigue durability, in particular, fatigue durability after a hole making because of frequent hole making (piercing), corrosion resistance and the like are important. It is important to balance the high strength and these characteristics at high level.

Transformation induced plasticity (TRIP) steel is disclosed in which both of an increase in strength and excellent various characteristics, particularly, formability are realized (for example, see Patent Documents 1 and 2). The TRIP steel includes residual austenite in the microstructure of the steel; and thereby, a TRIP phenomenon is expressed during a forming process. Accordingly, formability (ductility and deep drawability) is dramatically improved. However, stretch-flange formability generally deteriorates. Accordingly, a steel sheet having high strength and remarkably excellent stretch-flange formability is desired.

Several hot-rolled steel sheets having excellent stretch-flange formability are disclosed. Patent Document 3 discloses a hot-rolled steel sheet having a single phase microstructure of acicular ferrite. However, in the microstructure of a single low-temperature transformation product, ductility is low, and it is difficult to utilize the steel sheet for uses other than stretch-flange forming.

Patent Document 4 discloses a steel sheet having a microstructure consisting of ferrite and bainite. In the steel having a composite microstructure, relatively excellent ductility is obtained; however, a hole expansion ratio which is an index indicating stretch-flange formability tends to be low.

In addition, Patent Document 5 discloses a steel sheet having a high volume fraction of ferrite. However, since the steel sheet contains a large amount of Si, a problem is caused in fatigue properties and the like in some cases. In order to avoid a negative effect caused by Si, it is necessary to perform surface modification during and/or after a hot rolling. Therefore, there are many problems in that the introduction of special facilities is required or the productivity deteriorates.

Patent Documents 6 and 7 disclose a hot-rolled steel sheet in which Ti is added and which is excellent in hole expansionability. However, Ti/C is not properly controlled and a hole expansion ratio is not very high.

[Patent Document 1] Japanese Unexamined Patent Application, First Publication No. 2000-169935

[Patent Document 2] Japanese Unexamined Patent Application, Publication No. 2000-169936

[Patent Document 3] Japanese Unexamined Patent Application, First Publication No. 2000-144259

[Patent Document 4] Japanese Unexamined Patent Application, First Publication No. S61-130454

[Patent Document 5] Japanese Unexamined Patent Application, First Publication No. H08-269617

[Patent Document 6] Japanese Unexamined Patent Application, First Publication No. 2005-248240

[Patent Document 7] Japanese Unexamined Patent Application, First Publication No. 2004-131802

DISCLOSURE OF THE INVENTION

Problems To Be Solved By the Invention

The present invention aims to provide a hot-rolled steel sheet which has a maximum tensile strength of 520 to 720 MPa and excellent stretch-flange formability, ductility, fatigue properties, and particularly, fatigue properties even after hole making (piercing), and a method for manufacturing the same.

Means For Solving the Problems

The inventors of the present invention have conducted intensive studies to solve the problems. As a result, they newly found that, first, it is important to suppress a Si amount to an extremely low level, to control the microstructure to mainly include ferrite, to leave solid-solution C even in a small amount, and to pay attention to the ratio of a Ti amount to a C amount.

Further, they examined the form of a cross-section formed by a shear cutting which has a large effect on fatigue properties (piercing fatigue properties) when pierce-punching is performed.

FIG. 1 shows a photograph which is obtained by observing a shear-punched end face (the form of a cross-section formed by the shear cutting, and the cutting surface) with a microscope. Here, the upper part of FIG. 1 shows a result which is obtained by observing a normal fracture surface and the lower part thereof shows a result which is obtained by observing a normal fracture surface and an abnormal fracture surface.

FIG. 2 shows a SEM photograph of a normal fracture surface portion and FIG. 3 shows a SEM photograph of an abnormal fracture surface portion.

FIGS. 1 to 3 show the results which are obtained when a hot-rolled steel sheet is subjected to a shear cutting at a clearance of 12% of the sheet thickness and the obtained punched end face (the characteristics of a fracture surface of the punched portion) is observed.

The normal fracture surface as shown in FIGS. 1 and 2 is a ductile fracture surface, and the fracture surface (abnormal fracture surface) of the abnormal portion as shown in FIGS. 1 and 3 is a brittle fracture surface. It is thought that the brittle fracture surface is formed when a large amount of elongated ferrite grain boundaries are formed in the cutting surface or a large number of precipitates such as TiC are formed in ferrite grain boundaries.

Accordingly, in order to suppress the formation of the brittle fracture surface, it is important that (1) the form of crystal grains is controlled and (2) precipitates such as TiC are not formed.

The present invention aims to manufacture a hot-rolled steel sheet having a strength of 520 to 720 MPa. In the case of a precipitation strengthening where precipitates are utilized for strengthening, precipitates such as TiC are formed; and therefore, brittle fracture in the fracture surface cannot be prevented. Further, in the case where solid-solution elements such as C are used, hard secondary phases such as bainite, cementite, martensite and the like are precipitated, and at the same time, precipitates such as TiC are formed in many cases. Accordingly, brittle fracture in the fracture surface cannot be prevented. In addition, the hard phase lowers a hole expansion ratio. Moreover, the strength is insufficient when precipitates are not formed.

In view of the above-described problems, in the present invention, it was found that the following actions are obtained by forming Ti—C clusters.

1) The formation of mainly carbide-based precipitates such as TiC can be suppressed.

2) The formation of a hard secondary phase such as cementite can be suppressed.

3) It is possible to control the form of crystal grains to be a form in which brittle fracture (brittle fracture surface) is not easily caused.

4) By using a strain field formed around the Ti—C cluster, dislocation is fixed; and thereby, strength can be secured.

Further, it was found that when Nb is added, a recrystallization temperature is increased; and thereby, elongated ferrite grains are easily formed. Accordingly, from this point of view, it was found that Nb should not be contained.

The present invention has been completed as described above. That is, the features of the present invention are as follows.

A hot-rolled steel sheet excellent in fatigue properties and stretch-flange formability according to the present invention, includes: in terms of mass %, C: 0.015% or more to less than 0.040%; Si: less than 0.05%; Mn: 0.9% or more to 1.8% or less; P: less than 0.02%; S: less than 0.01%; Al: less than 0.1%; N: less than 0.006%; and Ti: 0.05% or more to less than 0.11%, with the remainder being Fe and inevitable impurities, wherein Ti/C is in a range of 2.5 or more to less than 3.5, Nb, Zr, V, Cr, Mo, B and W are not included, a microstructure includes a mixed microstructure of polygonal ferrite and quasi-polygonal ferrite in a proportion of greater than 96%, a maximum tensile strength is in a range of 520 MPa or more to less than 720 MPa, an aging index AI is in a range of more than 15 MPa, a product of a hole expansion ratio (λ) % and a total elongation (El) % is in a range of 2350 or more, and a fatigue limit is in a range of 200 MPa or more.

In the hot-rolled steel sheet excellent in fatigue properties and stretch-flange formability according to the present invention, the hot-rolled steel sheet may further include, in terms of mass %, either one or both of Cu: 0.01% or more to 1.5% or less and Ni: 0.01% or more to 0.8% or less.

The hot-rolled steel sheet may further include, in terms of mass %, either one or both of Ca: 0.0005% or more to 0.005% or less and REM: 0.0005% or more to 0.05% or less.

The hot-rolled steel sheet may be treated with plating.

A method for manufacturing a hot-rolled steel sheet excellent in fatigue properties and stretch-flange formability according to the present invention, the method includes: heating a slab at a temperature within a range of 1100° C. or higher, wherein the slab contains: in terms of mass %, C: 0.015% or more to less than 0.040%; Si: less than 0.05%; Mn: 0.9% or more to 1.8% or less; P: less than 0.02%; S: less than 0.01%; Al: less than 0.1%; N: less than 0.006%; and Ti: 0.05% or more to less than 0.11%, with the remainder being Fe and inevitable impurities, in which Ti/C is in a range of 2.5 or more to less than 3.5, and Nb, Zr, V, Cr, Mo, B and W are not contained, and subjecting the slab to a rough rolling under conditions where the rough rolling is completed at a temperature within a range of 1000° C. or higher so as to obtain a rough bar; subjecting the rough bar to a finish rolling under conditions where the finish rolling is completed at a temperature within a range of 830° C. to 980° C. so as to obtain a rolled steel; performing an air-cooling for 0.5 seconds or longer after the finish rolling, and performing cooling at an average cooling rate within a range of 10° C./sec to 40° C./sec in a temperature range of 750° C. to 600° C. so as to obtain a hot-rolled steel sheet; and coiling the hot-rolled steel sheet at a temperature within a range of 440° C. to 560° C., wherein the hot-rolled steel sheet is manufactured in which a microstructure includes a mixed structure of polygonal ferrite and quasi-polygonal ferrite in a proportion of greater than 96%, a maximum tensile strength is in a range of 520 MPa or more to less than 720 MPa, an aging index AI is in a range of 15 MPa or more, a product of a hole expansion ratio (λ) % and total elongation (El) % is in a range of 2350 or more, and a fatigue limit is in a range of 200 MPa or more.

In the method for manufacturing a hot-rolled steel sheet excellent in fatigue properties and stretch-flange formability according to the present invention, the rough bar or the rolled steel may be heated during a period until a start of the subjecting of the rough bar to the finish rolling and/or during the subjecting of the rough bar to the finish rolling.

Descaling may be performed between an end of the subjecting of the slab to the rough rolling and a start of the subjecting of the rough bar to the finish rolling.

The method may further include subjecting the hot-rolled steel sheet to annealing at a temperature within a range of 780° C. or lower.

The method may further include heating the hot-rolled steel sheet at a temperature within a range of 780° C. or lower, and then dipping the hot-rolled steel sheet in a plating bath so as to plate surfaces of the hot-rolled steel sheet.

The method may further include performing an alloying treatment after the plating.

Effects of the Invention

The present invention relates to a hot-rolled steel sheet which is particularly excellent in stretch-flange formability and a method of manufacturing the hot-rolled steel sheet. The steel sheet enables the formation into a component where a strict stretch flange processing is required, such as a formation of decorative hole portions of a high-design-property wheel. In addition, the characteristics of an end face after the stretch flange processing are excellent without occurring a secondary shearing surface and defects similar thereto.

In the case where the hot-rolled steel sheet of the present invention is used for a member such as a vehicle wheel which is used after holes are punched, fatigue failure which is caused around the holes can be effectively suppressed. When a brittle fracture (brittle fracture surface) is caused in the punched end face (cutting fracture surface) of a hole in punching the hole, fatigue failure is caused around the hole. In the hot-rolled steel sheet of the present invention, the occurrence of brittle fracture in a punched end face is suppressed; and therefore, fatigue failure can be effectively suppressed, and excellent fatigue properties (piercing fatigue properties) can be achieved.

In addition, the corrosion resistance after coating is also excellent. Regarding the strength of the steel sheet, a high strength of 520 to 670 MPa is obtained in terms of the maximum tensile strength while excellent fatigue properties are obtained. Accordingly, the sheet thickness can be decreased.

BEST MODE FOR CARRYING OUT THE INVENTION

Figure 1:
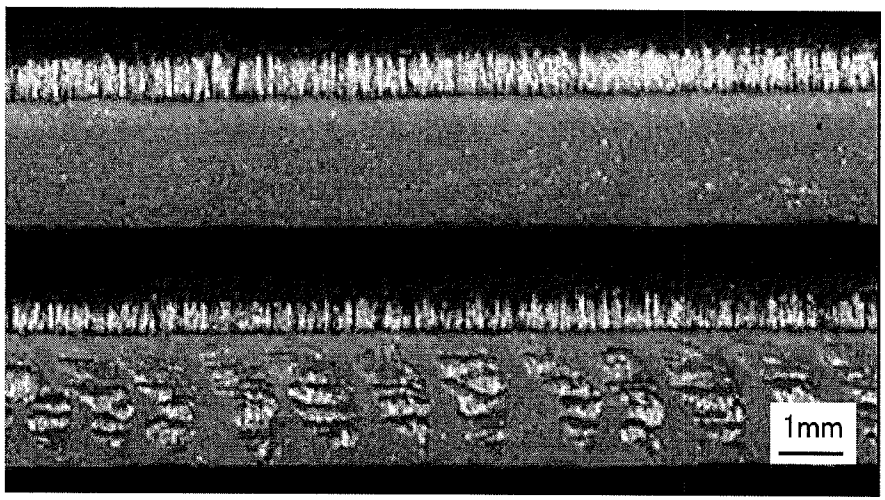
FIG. 1 is a diagram showing a photograph which is obtained by observing a shear-punched end face (the form of a cross-section formed by shear cutting) with a microscope.
Figure 2:
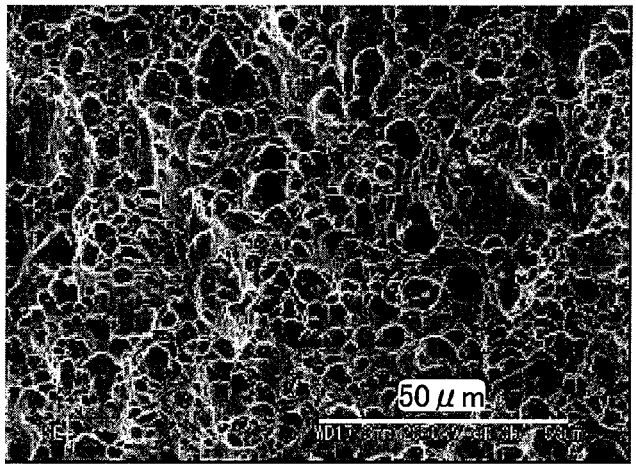
FIG. 2 is a diagram showing a SEM photograph of a normal fracture surface portion.
Figure 3:
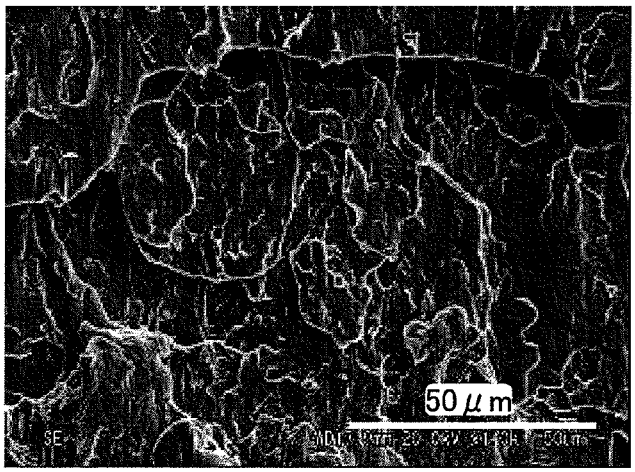
FIG. 3 is a diagram showing a SEM photograph of an abnormal fracture surface portion.

Hereinafter, the present invention will be described in detail.

First, chemical components of a hot-rolled steel sheet of the present invention will be described.

C is one of the most important elements in the present invention. In the case where 0.04% or more of C is contained, carbides acting as starting points of stretch-flange cracking are increased. As a result, not only does a hole expansion value deteriorate, but also strength is increased; and thereby, workability deteriorates. For this reason, the content of C is set to be in a range of less than 0.040%. From the point of view of stretch-flange formability, the content of C is preferably in a range of less than 0.035%. In the case where the content of C is in a range of less than 0.015%, the strength becomes insufficient; and therefore, the content of C is set to be in a range of 0.015% or more. The content of C is preferably in a range of 0.015% or more to less than 0.035%.

Si forms a surface pattern, which is referred to as Si-scale, on the surface of a hot-rolled sheet. As a result, not only surface properties of the formed product deteriorate, but also a surface roughness is increased. Accordingly, fatigue properties also deteriorate in some cases.

In addition, chemical conversion treatability deteriorates, and as a result, corrosion resistance also becomes poor. Accordingly, it is necessary to suppress the content of Si to be extremely low; and therefore, the upper limit of the Si content is set to be less than 0.05%. This allows excellent chemical conversion treatability and excellent corrosion resistance after coating to be secured with no need to perform a high-pressure descaling after a rough rolling. The lower limit is not particularly set. However, since a large increase in costs is required for setting the lower limit of the Si content to be less than 0.001%, the substantial lower limit of the Si content is 0.001% or more. The content of Si is preferably in a range of 0.001% or more to less than 0.01%.

Mn is an important element in the present invention. Since Mn makes a ferrite transformation temperature to be low, it has an effect of making the microstructure fine and is preferred for fatigue properties. In addition, since the strength can be increased at a comparatively low cost, 0.9% or more of Mn is added. Since the stretch-flange formability and fatigue properties are deteriorated by the addition of a too large amount of Mn, the upper limit of the Mn content is set to 1.8% or less. The upper limit of the Mn content is preferably less than 1.5%. The content of Mn is more preferably in a range of 1.0% to 1.4%.

Since P deteriorates a stretch-flange formability, a weldability and a fatigue strength of a welded portion, the upper limit of the P content is set to be less than 0.02%. The upper limit of the P content is more preferably less than 0.01%. The lower limit is not particularly limited. However, since it is difficult to set the lower limit of the P content to be 0.001% or less in view of a steel manufacturing technique, the substantial lower limit of the P content is more than 0.001%.

S causes cracking in hot rolling, and in the case where the content of S is too large, it forms A-based inclusions which deteriorate a hole expansionability; and therefore, the S content should be decreased as much as possible. However, the S content in a range of less than 0.01% is acceptable. The S content is preferably in a range of less than 0.0040% in the case where a high hole expansionability is required, and the S content is more preferably in a range of 0.0025% or less in the case where a higher hole expansionability is required. The lower limit is not particularly limited. However, since it is difficult to set the lower limit of the S content to be 0.0003% or less in view of a steel manufacturing technique, the substantial lower limit of the S content is more than 0.0003%.

Al may be added for deoxidization of molten steel. However, since an increase in costs is caused, the upper limit is set to be less than 0.1%. In the case where a too large amount of Al is added, a number of non-metallic inclusions increases; and thereby, elongation and hole expansionability are deteriorated. Accordingly, the Al content is preferably in a range of less than 0.06%. The content of Al is more preferably in a range of 0.01% to 0.05%. Al may not be added.

N combines with Ti to form TiN; and thereby, it has a bad effect on hole expansionability and fatigue properties. Therefore, the upper limit of the N content is set to be less than 0.006%, and is preferably less than 0.004%. The lower limit is not particularly limited. However, since it is difficult to stably obtain the N content of less than 0.0005%, the substantial lower limit of the N content is 0.0005% or more.

Ti is a very important element in the present invention. Ti is necessarily included to increase the strength and also has an effect of improving hole expansionability. Accordingly, it is essential to include 0.05% or more of Ti. However, in the case where a too large amount of Ti is added, the strength becomes so high that hole expansionability, fatigue properties or piercing fatigue properties are decreased in some cases. Accordingly, the upper limit of the Ti content is set to be less than 0.11%. The content of Ti is more preferably in a range of 0.075% or more to less than 0.10%.

In the case where the surface of a hot-rolled steel sheet is treated with plating, and is further treated with an alloying treatment (also referred to as an alloyed hot-dipped steel sheet), the content of Ti is preferably in a range of 0.05% to 0.10%. In an alloyed hot-dipped steel sheet, TiC precipitates are easily formed in the course of alloying; and therefore, the lower limit of the Ti content is preferably 0.05% or more.

However, the content of Ti is more preferably in a range of more than 0.06% in order to further stably form Ti—C clusters.

Ti/C is set to be in a range of 2.5 or more to less than 3.5 in terms of a mass ratio. In the case where the steel is manufactured under conditions in which the content of C is in a range of 0.015% or more to less than 0.040%, Ti/C is in a range of 2.5 or more to less than 3.5, and the time period during which the temperature reaches 700° C. from the end of finish rolling is in a range of 5 to 20 seconds, Ti—C clusters are easily formed.

Herein, the Ti—C cluster means a configuration in which Ti captures C, although precipitates of TiC are not easily formed. Since Ti captures C, precipitation of cementite which normally occurs at a temperature within a range of 440° C. to 560° C. can be suppressed. In addition, precipitation of bainite can also be suppressed.

Figure 4:
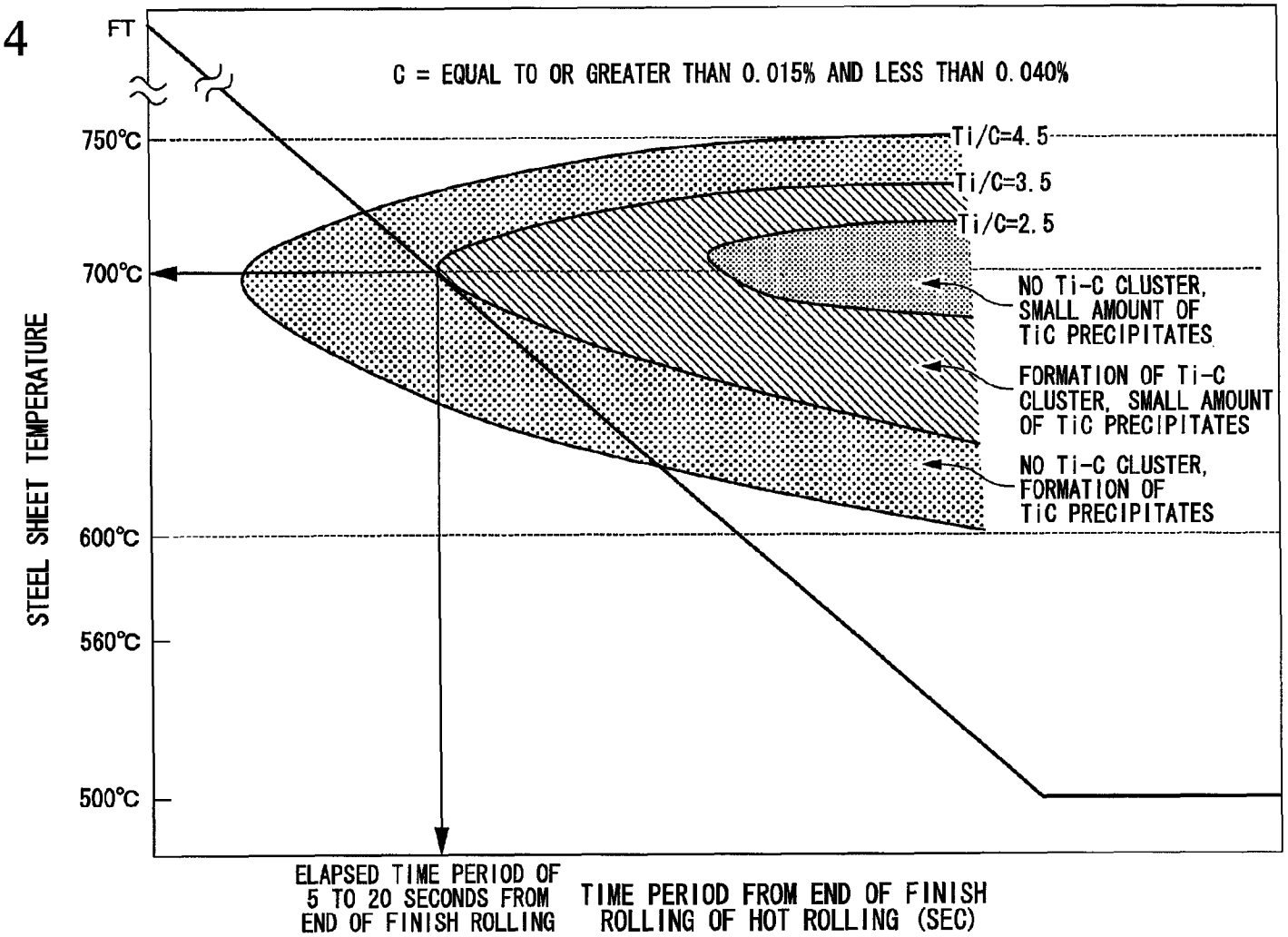
FIG. 4 is a diagram schematically showing an area in which Ti—C clusters and TiC precipitates are formed in the relationship between a steel sheet temperature and an elapsed time period from the end of a finish rolling.

FIG. 4 is a diagram schematically showing areas in which Ti—C clusters and TiC precipitates are formed in a relation between a steel sheet temperature and an elapsed time period from the end of a finish rolling. In the diagram, the line segment (the line segment which is inclined from the upper left to the lower right and is horizontally positioned at or in the vicinity of 500° C.) indicates a temporal change of the steel sheet temperature from the end of the finish rolling (also referred to as a temporal change of the steel sheet temperature in the course of cooling, or a cooling curve), and the case is shown where the line segment is in contact with the border line of the area in which Ti—C clusters and TiC precipitates are formed when Ti/C is equal to 3.5.

Since the atomic weight of Ti is 48 and the atomic weight of C is 12, the atomic ratio (molar ratio) of Ti to C is 1:1 when Ti/C is equal to 4. In addition, the content of Ti combining with N is about 0.02%. Accordingly, when Ti/C is in a range of 2.5 or more to less than 3.5, the amount of C becomes surplus. However, the precipitation of cementite does not occur under conditions where the content of C is in a range of the present invention and the cooling rate is in a range of the present invention.

In order to intersect the precipitation nose of Ti/C with the cooling curve of the steel sheet, the cooling curve of the steel sheet is made to pass through the point at which the time period of 5 to 20 seconds passes at 700° C. That is, a cooling is performed such that the steel sheet temperature reaches 700° C. during 5 to 20 seconds passes from the end of the finish rolling. The elapsed time period during which the steel sheet temperature reaches 700° C. is preferably in a range of 10 to 15 seconds.

In order to generate Ti—C clusters, it is necessary for the line segment to pass through the area (oblique line portion) in which the Ti—C clusters are formed.

As shown in FIG. 4, the value of Ti/C and the area of steel sheet temperature-elapsed time period at which TiC precipitates are formed, are different from the value of Ti/C and the area of steel sheet temperature-elapsed time period at which Ti—C clusters are formed. Accordingly, when Ti—C clusters are formed, the formation of TiC precipitates is suppressed.

In the case where Ti/C is less than 2.5, a high strength cannot be stably obtained. In addition, since both of the amount of TiC precipitates and the amount of Ti—C clusters are small, a strength cannot be secured. On the other hand, in the case where Ti/C is 3.5 or more, it becomes difficult to secure the amount of solid-solution C, which will be described later and is very important in the present invention. As a result, hole expansionability and fatigue properties are deteriorated. In addition, TiC precipitates are easily precipitated, and Ti—C clusters are hardly formed.

The amounts of TiN (precipitates) and TiC precipitates in a hot-rolled steel sheet can be measured as equivalent amounts of Ti by collecting extraction residues from the steel sheet and measuring the amounts of Ti components. Accordingly, the amount of Ti—C clusters can be calculated by the calculation formula of (the added amount of Ti)−(the amount of Ti as TiC precipitates)−(the amount of Ti as TiN). The amount of Ti as Ti—C clusters, which is calculated by the calculation formula, is in a range of about 0.02% to 0.07%.

The amount of Ti as TiC precipitates in terms of an equivalent amount of Ti is about 0.02% and the amount of Ti as TiN in terms of an equivalent amount of Ti is about 0.02%.

In the electrolytic extraction residue analysis, a filter of 0.2 μm is used. However, not all the precipitates having a size of 0.2 μm or smaller pass through the filter, and in practice, due to an aggregation effect of fine precipitates or an effect of filter clogging, precipitates of several-nm order are also comparatively extracted, and this is confirmed by an electron microscope. Accordingly, it is thought that the precipitates which are extracted to measure the amount of Ti as TiC precipitates or the amount of Ti as TiN have sizes of about 5 nm or larger.

In the present invention, it was found that in the case where the amount of TiC precipitates in terms of an equivalent amount of Ti is about 0.02% and the amount of TiN in terms of an equivalent amount of Ti is about 0.02%, these amounts do not affect the brittle fracture surface of a cutting surface. This result is closely related to the proportions of polygonal ferrite and quasi-polygonal ferrite in the microstructure which is to be described later.

In the present invention, strengthening due to Ti—C clusters is carried out (strength is enhanced by Ti—C clusters). When Ti—C clusters are generated, a strain field is formed in the crystals around the Ti—C cluster. Accordingly, dislocations are fixed; and thereby, strength can be improved.

Since TiN (precipitate) becomes coarse, it cannot be used as a strengthening element.

TiC precipitates cause cracking in the end face and lowers a fatigue limit Accordingly, it is desirable that the precipitated amount thereof is small and these cannot be used as a strengthening element.

In the present invention, since Nb is not contained, composite precipitates such as NbC and TiNbCN are not used as strengthening elements. Since the composite precipitates such as NbC and TiNbCN also easily form the brittle fracture surface of a cutting surface, precipitation thereof should be avoided.

In the present invention, since Ti—C clusters are used, Nb must not be added. In the case where Nb is added, NbC is precipitated; and thereby, the formation of Ti—C clusters is inhibited. In addition, Ti—C clusters are broken down. When the formation of Ti—C clusters is suppressed, a decrease in strength, the suppression of cracking in an end face and a decrease in a fatigue limit occur. In addition, in the case where Nb is added, a recrystallization temperature is increased; and thereby, elongated ferrite crystal grains are easily formed. Accordingly, from this point of view, it was found that Nb should not be contained.

Further, the hot-rolled steel sheet of the present invention does not contain Zr, V, Cr, Mo, B and W. Zr, V, Cr, Mo, B and W form carbides, but these elements also inhibit the formation of Ti—C clusters or the breaking down of Ti—C clusters. Accordingly, these Zr, V, Cr, Mo, B and W are also not contained.

The content of O is not particularly limited. However, in the case where the content of O is too large, the amount of coarse oxides increase; and thereby, hole expansionability is deteriorated. Accordingly, the upper limit is substantially 0.012%, preferably 0.006% or less, and more preferably 0.003% or less.

Next, in the present invention, if necessary, at least one selected from the group consisting of Cu, Ni, Ca and REM (rare-earth element) may be contained. Hereinafter, the elemental components will be described.

Either one or both of Cu and Ni, which are precipitation strengthening elements or solid-solution strengthening elements, may be added so as to attain a stronger strength. However, in the case where the content of Cu or the content of Ni is less than 0.01%, the above effect cannot be obtained. In addition, even in the case where more than 1.5% of Cu or more than 0.8% of Ni is added, the above effect is saturated, and in addition, the formability is deteriorated, and costs increase.

Ca and REM are elements for changing the form of non-metallic inclusions, which become the starting point of fracture or deteriorate workability, so as to render the non-metallic inclusions harmless. However, regarding these, in the case where the added amount of these is less than 0.0005%, the above effect is not obtained. Moreover, in the case where more than 0.005% of Ca or more than 0.05% of REM is added, the above effect is saturated. Accordingly, it is desirable that Ca: 0.0005% to 0.005% or REM: 0.0005% to 0.05% is added. Here, REM is rare-earth metal and is at least one selected from Sc, Y and lanthanoids of La, Ce, Pr, Nd, Pm, Sm, Eu, Gd, Tb, Dy, Ho, Er, Tm, Yb and Lu.

In the steel including the above elements as main components, at least one selected from the group consisting of Sn, Co, Zn and Mg may be contained at a total amount within a range of 1% or less. However, it is desirable that the content of Sn is in a range of 0.05% or less because there is a concern that flaws may be generated in a hot rolling.

Next, the microstructure of a hot-rolled steel sheet of the present invention will be described. The main phase of the microstructure is ferrite. Ferrite is a mixed microstructure of polygonal ferrite (PF) and quasi-polygonal ferrite (hereinafter, referred to as $\alpha q$). The total amount of quasi-polygonal ferrite and polygonal ferrite is in a range of more than 96%, and preferably in a range of 98% or more.

Regarding quasi-polygonal ferrite, the inner microstructure does not appear by etching as is the case with polygonal ferrite (PF). However, the form is a divided acicular, and quasi-polygonal ferrite is clearly distinguished from polygonal ferrite. Herein, when the peripheral length of target crystal grains is denoted by lq, and the equivalent circle diameter thereof is denoted by dq, crystal grains satisfying the ratio (lq/dq) of 3.5 or more are quasi-polygonal ferrite.

As defined in the above description, quasi-polygonal ferrite is ferrite having a form which is not completely circular and in which grain boundaries are jagged. Accordingly, in the case where quasi-polygonal ferrite is mixed with polygonal ferrite, brittle fracture of a cutting surface is not easily caused.

This mixed microstructure is formed at a temperature within a range of about 750° C. to 650° C., and this temperature is almost the same as the temperature range at which Ti—C clusters are formed. Therefore, the Ti—C clusters relate to the formation of polygonal ferrite and quasi-polygonal ferrite, and particularly, the Ti—C clusters relate closely to the formation of quasi-polygonal ferrite.

That is, it was found that under the conditions of forming Ti—C clusters, the mixed microstructure of polygonal ferrite and quasi-polygonal ferrite is easily formed as a microstructure.

Regarding the mixing ratio in the ferrite microstructure as the mixed microstructure, it is preferable that the amount of polygonal ferrite is in a range of 30% to 70% and the remainder is quasi-polygonal ferrite.

The grain boundaries of polygonal ferrite are linear, but the grain boundaries of quasi-polygonal ferrite are complicated. In the present invention, the precipitated amount of TiC precipitates is very small. However, in the case where TiC precipitates are on the grain boundaries of polygonal ferrite, this may be a cause leading to the forming of a brittle fracture surface. In contrast, in the case where the amount of polygonal ferrite is in a range of 30% to 70% and the remainder is quasi-polygonal ferrite, and both microstructures thereof are juxtaposed with each other, the formation of a brittle fracture surface does not occur.

Meanwhile, it is not preferable that the mount of polygonal ferrite is in a range of less than 30% in terms of the mixing ratio in the ferrite microstructure, because there are few precipitates in the present invention; and therefore, it becomes difficult to secure the strength of the present invention to be in a range of 520 MPa or more. Here, in order to attain the amount of polygonal ferrite of less than 30%, transformation occurs in a low-temperature range, and at the same time, bainitic ferrite or bainite is easily formed. Accordingly, in practice, it is very difficult to achieve a microstructure consisting of polygonal ferrite and quasi-polygonal ferrite and to control the mount of polygonal ferrite to be in a range of less than 30%.

It is not preferable that bainitic ferrite or bainite is contained, because there are few precipitates in the present invention; and therefore, it becomes difficult to secure the strength of the present invention to be in a range of 520 MPa or more.

It is not preferable that the amount of polygonal ferrite is in a range of more than 70% in terms of the mixing ratio in the ferrite microstructure, because a brittle fracture surface is easily formed.

In a microstructure in which the mixed microstructure (ferrite) of polygonal ferrite and quasi-polygonal ferrite and bainite are mixed or a microstructure in which ferrite and bainitic ferrite are mixed, a difference in hardness exists in the microstructure and the difference in hardness is large. Accordingly, in the case where a hole expansion ratio is in a range of 120% or more or in a range of 140% or more, or in the case where a product of a hole expansion ratio and a total elongation is in a range of 2350 or more, hole expansionability is easily deteriorated. Accordingly, the above-described microstructures are not preferred as the microstructure of the hot-rolled steel sheet of the present invention.

When the content of bainitic ferrite, bainite or perlite is in a range of 4% or less in terms of the area ratio, the probability of the appearance of these microstructures in a punched end face becomes very low. Accordingly, hole expansionability is little deteriorated; and therefore, the microstructures may be permitted in some cases. However, the content of bainitic ferrite, bainite or perlite is preferably in a range of 2% or less, and in this case, the deterioration of the hole expansionability can be more effectively controlled. It is most preferable that these microstructures do not exist.

Martensite and residual austenite which are much harder microstructures must not be contained.

Further, a large amount of TiC precipitates tend to be formed at grain boundaries. Accordingly, in the case where a large amount of TiC precipitates are precipitated, the formation of Ti—C clusters is suppressed, and in addition, the formation of embrittlement cracking, that is an abnormal fracture surface, is promoted which is caused along grain boundaries when punching is performed. Accordingly, the strengthening of grain boundaries becomes weaker. Further, TiC precipitates have a tendency to become starting points of the generation of cracks or flange cracking when stretch-flange forming is performed. Accordingly, in the case where a hole expansion ratio is in a range of 120% or more or in a range of 140% or more, or in the case where a product of a hole expansion ratio and a total elongation is in a range of 2350 or more, brittle fracture of a cutting surface is easily caused. Therefore, it is necessary to suppress the brittle fracture. The amount of TiC precipitates in terms of an equivalent amount of Ti is preferably in a range of 0.03% or less, and more preferably in a range of 0.02% or less.

There is a possibility that TiN becomes a starting point of cracking as in the case of TiC precipitates; and therefore, the amount of TiN precipitates or TiC precipitates is preferably in a range of 0.02% or less in terms of an equivalent amount of Ti (a value which is measured by an extraction residue method).

In the fraction of a microstructure, precipitated grains of carbides such as cementite and TiC precipitates, sulfides such as MnS, nitrides such as TiN, carbosulfides such as $Ti_4C_2S_2$ and the like, or crystallized grains of oxides and the like are not included.

Next, a maximum tensile strength, an aging index AI, a product of a hole expansion ratio (λ)% and a total elongation (El)%, and a fatigue limit of the hot-rolled steel sheet of the present invention will be described.

The maximum tensile strength of a hot-rolled steel sheet of the present invention is in a range of 520 MPa or more to less than 720 MPa. In the case where the maximum tensile strength is in a range of less than 520 MPa, the merit of an increase in strength is reduced, and in the case where the maximum tensile strength is in a range of than 720 MPa or more, the formability is deteriorated. Meanwhile, when a strict formability or shape fixability for a high-design-property wheel or the like is required, it is more desirable that the maximum tensile strength is in a range of less than 670 MPa. Here, the maximum tensile strength is measured through a tensile test which is performed in accordance with a method of JIS Z 2241.

The aging index AI is very important in the present invention.

In general, the amount of C, which is not fixed by Ti as TiC precipitates, is defined as solid-solution C and is estimated by using an internal friction method. However, since Ti—C clusters are formed in the hot-rolled steel sheet of the present invention, the amount of C in the generated Ti—C clusters cannot be evaluated by the internal friction method which is a general method for measuring the amount of solid-solution C. That is, the Ti—C cluster is not solid-solution C.

Accordingly, in the present invention, the value of AI is used to evaluate the amount of Ti—C clusters. In the evaluation method of AI, since the temperature is increased to 100° C., a part of C combining with Ti in the Ti—C cluster is separated from the capture of Ti and has an action of fixing mobile dislocation. Accordingly, there is a certain relation between the value evaluated by AI and the amount of the Ti—C clusters. Conversely, a low value of AI also means the formation of a large amount of TiC precipitates; and therefore, in the case where the value of AI is low, a brittle fracture surface tends to be easily formed. Accordingly, it was found that the value of AI has a close relationship with the brittle fracture behavior of a cutting surface as shown in examples.

The value of AI is in a range of more than 15 MPa. In the case where the value of AI is in a range of 15 MPa or less, it is not possible to secure excellent hole expansionability and fatigue properties. The upper limit of the value of AI is not particularly provided. However, in the case where the value of AI is more than 80 MPa, the amount of solid-solution C becomes too large; and thereby, formability is decreased in some cases. Accordingly, the upper limit is preferably 80 MPa or less.

In addition, in the case of a steel sheet of the present invention, the value of AI is measured as follows. First, a tensile strain within a range of 6.5% to 8.5% is applied to a test piece. The flow stress at this time is denoted by $\sigma 1$. The test piece is removed from a tensile tester by unloading, and is subjected to a heat treatment at 100° C. for 1 hour. Then, the tensile test is performed once again. The upper yield stress obtained by the test is denoted by $\sigma 2$. The value of AI is defined by the equation, AI (MPa)=$\sigma 2-\sigma 1$. The tensile test is performed in accordance with a method of JIS Z 2241.

The better the balance between a hole expansion value and total elongation, the more excellent the stretch-flange formability. In the case where the product of a hole expansion ratio (%) and a total elongation (%) is in a range of less than 2350, the probability of causing stretch-flange cracking during the forming becomes higher. Accordingly, the optimum range of the product of the hole expansion ratio (%) and the total elongation (%) is limited to be 2350 or more. As a condition for not causing cracking even in a shaped product with a stricter shape, the product of the hole expansion ratio (%) and the total elongation (%) is preferably in a range of 3400 or more.

In the case in which a steel sheet of the present invention is applied to a high-design-property wheel member, if a hole expansion ratio is less than 140%, cracking may occur in a flange end face in some cases. Therefore, it is preferable that the hole expansion ratio is in a range of 140% or more. It is more preferable that the hole expansion ratio is in a range of 160% or more. Here, the hole expansion ratio is measured in accordance with a hole expansion testing method described in Japan Iron and Steel Federation Standard JFS T 1001-1996.

Fatigue properties are defined in accordance with JIS Z 2275. A test shape is defined in accordance with JIS Z 2275. For the evaluation, a complete both vibrating and bending fatigue test (stress ratio R=−1) with a constant stress amplitude is performed and the upper limit of fatigue strength at $1\times10^7$ repetitions is set as a fatigue limit. In the case where the fatigue limit is in a range of less than 200 MPa, fatigue failure may be caused during the use of a shaped product in some cases. Accordingly, a proper range of the fatigue limit is limited to be 200 MPa or more, and preferably 220 MPa or more.

In some cases, depending on the test time, the fatigue test may be terminated at $1\times10^6$ repetitions or $2\times10^6$ repetitions. In these cases, the fatigue limit becomes higher than that in the case of $1\times10^7$ repetitions.

In a hot-rolled steel sheet of the present invention, it is preferable that a piercing fatigue limit is in a range of 200 MPa or more.

The piercing fatigue limit is measured as follows. The testing method thereof is conducted in accordance with JIS Z 2275 as same as the above-described fatigue test. A test shape is defined in accordance with JIS Z 2275. However, the piercing fatigue limit test is different from the above-described fatigue test in that punched holes with a punch diameter Φ of 10 mm are formed at a clearance of 12% in the center of a fatigue test piece. As in the case of fatigue properties, a complete both vibrating and bending fatigue test (stress ratio R=−1) with a constant stress amplitude is performed and the upper limit of fatigue strength at $1\times10^7$ repetitions is obtained as a piercing fatigue limit.

The inventors found that fatigue failure is easily caused around the punched hole in the case where a brittle fracture surface including a cleavage fracture surface, a grain-boundary fracture surface, or an interfacial fracture surface exists in a punched end face of the hole. The fatigue test properties (piercing fatigue limit) of the member subjected to piercing punching reflects the ease of the occurrence of a fatigue failure, and in the case where the piercing fatigue limit is in a range of 200 MPa or more, it is possible to achieve particularly excellent piercing fatigue properties.

The hot-rolled steel sheet of the present invention may be subjected to plating (treated with plating). The main component of plating may be zinc, aluminum, tin or any other component. In addition, the plating may be hot-dip plating, alloying hot-dip plating, or electroplating. As a chemical component of plating, at least one of Fe, Mg, Al, Cr, Mn, Sn, Sb, Zn and the like may be contained together with the main component.

Next, a method of manufacturing a hot-rolled steel sheet of the present invention will be described.

The method for manufacturing a hot-rolled steel sheet of the present invention is a method of subjecting a slab to a hot rolling to obtain a hot-rolled steel sheet, and includes: a rough rolling process of rolling a slab to obtain a rough bar (also referred to as a sheet bar); a finish rolling process of rolling the rough bar to obtain a rolled steel; a cooling process of cooling the rolled steel to obtain a hot-rolled steel sheet; and a process of coiling the hot-rolled steel sheet.

In the present invention, a manufacturing method preceding the hot rolling is not particularly limited. That is, it is desirable that a melting is conducted by a blast furnace, a converter, an electric furnace or the like, and then a component adjustment is performed by various secondary refining processes so as to obtain target contents of components. Thereafter, a casting is performed by employing a method such as a general continuous casting, a casting by an ingot method, or a thin-slab casting. Scraps may be used as a raw material. In the case of a slab obtained by the continuous casting, the slab may be directly transported to a hot rolling mill while being in a high-temperature state, or the slab may be cooled to room temperature and then re-heated by a heating furnace so as to be subjected to a hot rolling. The components of the slab are the same as the above-described components of the hot-rolled steel sheet of the present invention.

First, it is necessary to heat a slab at a temperature within a range of 1100° C. or higher. In the case where the temperature (slab extraction temperature) is in a range of lower than 1100° C., it is difficult to obtain sufficient strength. It is thought that this is because Ti-based carbides are not sufficiently dissolved at a temperature within a range of lower than 1100° C.; and as a result, precipitates become coarser. The slab extraction temperature is more preferably in a range of 1140° C. or higher. The upper limit is not particularly provided. However, there is no particular effect even when the temperature is in a range of higher than 1300° C.; and therefore, the upper limit is substantially 1300° C. or lower due to an increase in costs.

The heated slab is subjected to a rough rolling to obtain a rough bar. The end temperature of the rough rolling is very important in the present invention. That is, it is necessary to complete the rough rolling at a temperature within a range of 1000° C. or higher. This is because in the case where the end temperature is in a range of lower than 1000° C., hole expansionability is deteriorated. Accordingly, the lower limit is set to be in a range of 1000° C. or higher, and preferably in a range of 1060° C. or higher. The upper limit of the end temperature is not particularly provided. However, the upper limit is substantially the slab extraction temperature to the extent that it does not lead to an increase in costs.

Then, the rough bar is subjected to a finish rolling to obtain a rolled steel. The finishing temperature of the finish rolling is set to be in a range of 830° C. to 980° C. In the case where this temperature is in a range of lower than 830° C., the strength of a hot-rolled steel sheet greatly varies in accordance with conditions of cooling or coiling after the hot rolling (rough rolling and finish rolling), or in-plane anisotropy of tensile properties becomes larger. In addition, sine the hole expansionability is also deteriorated, the lower limit is set to be 830° C. or higher. It is not preferable that the finishing temperature is in a range of higher than 980° C. because the hot-rolled steel sheet becomes harder; and thereby, the ductility deteriorates, and in addition, hot-rolling rolls easily become worn. Accordingly, the upper limit of the finishing temperature is set to 980° C. The finishing temperature of the finish rolling is preferably in a range of 850° C. to 960° C., and is more preferably in a range of 870° C. to 930° C.

After the finish rolling, the rolled steel is air-cooled for 0.5 seconds or longer. In the case where the time period is shorter than 0.5 seconds, excellent hole expansionability cannot be obtained. The reason for this is not necessarily clear. However, it is thought that in the case where the time period is shorter than 0.5 seconds, recrystallization of austenite does not proceed, and as a result, anisotropy of mechanical characteristics becomes larger and the hole expansionability tends to be decreased. It is preferable that the time period for the air-cooling is set to be in a range of longer than 1.0 second.

Subsequently, the rolled steel is cooled to obtain a hot-rolled steel sheet. In this cooling process, an average cooling rate in a temperature range of 750° C. to 600° C. is set to be in a range of 10° C./sec to 40° C./sec. The cooling rate is preferably in a range of 15° C./sec to 40° C./sec, and more preferably in a range of more than 20° C./sec to 35° C./sec or less.

In the case where the ratio of Ti/C is in a range of 2.5 or more to less than 3.5, and the cooling rate is in a range of 10° C./sec to 40° C./sec, Ti—C clusters are easily formed.

In the case where Ti/C is in the above-described range and the cooling rate is in a range of lower than 10° C./sec, TiC precipitates are precipitated; and thereby, a brittle fracture surface is formed.

On the other hand, in the case where the cooling rate is higher than 40° C./sec, the microstructure is converted into bainite. In the present invention, since the precipitation of TiC is strongly suppressed, the strength becomes less than 520 MPa in the bainite microstructure; and therefore, target characteristics of the present invention are not satisfied. Conversely, in the case where the strength is increased to 520 MPa or greater by precipitating TiC precipitates, a brittle fracture surface is formed; and thereby, the piercing fatigue limit is lowered.

In the case where the cooling rate is in a range of 10° C./sec to 40° C./sec, and Ti/C is in a range of less than 2.5, TiC precipitates are not precipitated. Accordingly, a microstructure consisting of only polygonal ferrite is obtained and quasi-polygonal ferrite is not formed. In this case, the strength becomes less than 520 MPa; and therefore, target characteristics of the present invention are not satisfied.

In the case where the cooling rate is in a range of 10° C./sec to 40° C./sec, and Ti/C is in a range of 3.5 or more, TiC precipitates are precipitated, and a brittle fracture surface is formed; and thereby, the piercing fatigue limit is lowered.

In order to effectively form Ti—C clusters, it is necessary to increase the austenite grain diameter before the finish rolling to be in a range of about 60 to 150 μm so as to suppress the precipitation of TiC precipitates after the finish rolling. In this manner, since precipitation sites of TiC precipitates are suppressed, it is possible to decrease the precipitation of fine TiC precipitates in the course of cooling after the finish rolling.

For this, it is preferable to adjust a time period from the end of the rough rolling to the start of the finish rolling to be in a range of 60 to 200 seconds. In the present invention, Nb is not contained. However, if Nb is contained, Nb itself suppresses the recrystallization of austenite; and therefore, the austenite grain diameter is not increased to be in a range of 60 μm or larger even when the steel is held for the same period of time. Accordingly, in the case where Nb is contained, precipitation sites of TiC precipitates after the finish rolling increase even when the steel is held for the same period of time; and thereby, refinement of TiC precipitates is promoted. In the present invention, since Nb is not contained, the above-described situation does not occur.

After that, the hot-rolled steel sheet is coiled. The coiling temperature is set to be in a range of 440° C. to 560° C. In the case where the coiling temperature is in a range of lower than 440° C., a hard microstructure such as bainite or martensite appears and the hole expansionability is deteriorated. In the case where the coiling temperature is in a range of higher than 560° C., it becomes difficult to secure solid-solution C, which is one of the most important requirements in the present invention, and as a result, the hole expansionability may become poorer in some cases. The coiling temperature is preferably in a range of 460° C. to 540° C.

The rough bar after the rough rolling may be heat-treated during the period up to the end of the finish rolling (during the finish rolling). The heat treatment may also be performed on the rough bar after the rough rolling during the period up to the start of the finish rolling. In this manner, the temperature of the steel sheet in a width direction and a longitudinal direction becomes uniform and a variation in a material quality in a coil of a product becomes small. The heating method is not particularly designated. However, a method such as furnace heating, induction heating, energization heating, or high-frequency heating may be employed.

Descaling may be performed between the end of the rough rolling and the start of the finish rolling. In this manner, surface roughness becomes smaller, and the fatigue properties and the hole expansionability are improved in some cases. The descaling method is not particularly designated. However, the method using high-pressure water flows is most general.

The obtained hot-rolled steel sheet may be re-heated (annealing). In this case, in the case where the re-heating temperature is in a range of higher than 780° C., the tensile strength and the fatigue limit of the steel sheet are lowered; and therefore, a proper range of the re-heating temperature is limited to be 780° C. or lower. From the point of view of the stretch-flange formability, the temperature is more preferably in a range of 680° C. or lower. The heating method is not particularly designated. A method such as furnace heating, induction heating, energization heating, or high-frequency heating may be employed. The heating period is not particularly limited. However, in the case where a heating holding period at a temperature within a range of 550° C. or higher exceeds 30 minutes, it is desirable that the maximum heating temperature is set to be in a range of 720° C. or lower in order to obtain the strength of 520 MPa or greater.

The hot-rolled steel sheet may be subjected to acid washing in accordance with a purpose or may be subjected to skin pass. Since the skin pass rolling is effective in shape correcting and an improvement in aging properties and fatigue properties, the skin pass rolling may be performed before or after the acid washing. When the skin pass rolling is performed, it is preferable that the upper limit of the rolling reduction is set to be 3%. This is because the formability of the steel sheet is deteriorated in the case where the rolling reduction is greater than 3%.

After the acid washing of the obtained hot-rolled steel sheet, the hot-rolled steel sheet may be heated and subjected to hot-dip plating by using continuous zinc plating facilities or continuous annealing zinc plating facilities. In the case where a heating temperature of the steel sheet is in a range of higher than 780° C., the tensile strength and the fatigue limit of the steel sheet are lowered; and therefore, a proper range of heating temperature is limited to be 780° C. or lower.

Further, after the hot-dip plating, a plating alloying process (alloying treatment) may be performed for an alloying hot-dip galvanization.

The heating temperature is more preferably in a range of 680° C. or lower from the point of view of the stretch-flange formability.

Descaling may be performed between the end of the rough rolling and the start of the finish rolling. It is desirable that the scale on the surface is removed by descaling such that the maximum height Ry of the steel sheet surface after the finish rolling becomes in a range of 15 μm or less (15 μmRy, 1 (sampling length) 2.5 mm, In (travelling length) 12.5 mm). This becomes apparent from the fact that there is a certain association between the maximum height Ry of the steel sheet surface and the fatigue strength of the steel sheet subjected to the hot rolling or acid washing, as described on page 84 of the Metal Material Fatigue Design Handbook, edited by the Society of Materials Science, Japan. In addition, it is desirable that the subsequent finish rolling is started within 5 seconds in order to prevent scale from being newly generated after the descaling. Ra, which is defined in JIS B 0601, is preferably in a range of less than 1.40 μm, and more preferably in a range of less than 1.20 μm.

The sheet bar may be joined between the rough rolling and the finish rolling so as to continuously perform the finish rolling. At that time, the rough bar may be wound into a coil shape, and if necessary, may be stored in a cover having a heat retention function, and then wound back once again so as to be joined.

EXAMPLES

Hereinafter, the present invention will be further described by examples.

Steels A to R (thin steel sheet) having chemical components shown in Table 1 were manufactured by the following method. First, melting by a converter was performed to carry out continuous casting; and thereby, slabs were produced. Under the conditions shown in Tables 2 and 3, the slabs were re-heated and subjected to rough rolling to produce rough bars, and then the rough bars were subjected to finish rolling to obtain rolled steels having a sheet thickness of 4.5 mm (2.2 mm to 5.6 mm, as the range of the thicknesses of the manufactured steel sheets of the present invention). After that, the rolled steels were cooled and then coiled to obtain hot-rolled steel sheets (thin steel sheets).

The time period from the end of the rough rolling to the start of the finish rolling was set to be in a range of 60 to 200 seconds; and thereby, the grain diameter of austenite before the finish rolling was adjusted to be in a range of about 60 to 150 μm.

TABLE 1

| Steel No. | C | Si | Mn | P | S | Al | N |
|---|---|---|---|---|---|---|---|
| A | 0.02 | 0.005 | 1.03 | 0.006 | 0.002 | 0.033 | 0.0016 |
| B | 0.026 | 0.011 | 1.22 | 0.007 | 0.0036 | 0.022 | 0.0022 |
| C | 0.034 | 0.009 | 1.45 | 0.007 | 0.0024 | 0.018 | 0.0018 |
| D | 0.025 | 0.01 | 1.53 | 0.008 | 0.0029 | 0.031 | 0.0025 |
| E | 0.028 | 0.008 | 0.98 | 0.011 | 0.0035 | 0.028 | 0.003 |
| F | 0.03 | 0.012 | 1.16 | 0.009 | 0.0027 | 0.003 | 0.0024 |
| G | 0.029 | 0.009 | 1.15 | 0.005 | 0.003 | 0.02 | 0.0023 |
| H | 0.028 | 0.01 | 1.2 | 0.006 | 0.0028 | 0.021 | 0.0023 |
| I | 0.017 | 0.009 | 1.95 | 0.008 | 0.0032 | 0.029 | 0.0019 |
| J | 0.048 | 0.02 | 1 | 0.007 | 0.0026 | 0.03 | 0.0027 |
| K | 0.025 | 0.181 | 1.2 | 0.005 | 0.0016 | 0.04 | 0.002 |
| L | 0.020 | 0.010 | 1.0 | 0.010 | 0.0008 | 0.04 | 0.0023 |
| M | 0.028 | 0.010 | 1.6 | 0.010 | 0.0008 | 0.04 | 0.0023 |
| N | 0.019 | 0.009 | 1.1 | 0.008 | 0.0012 | 0.01 | 0.0025 |
| O | 0.037 | 0.006 | 1.0 | 0.013 | 0.0028 | 0.013 | 0.0030 |
| P | 0.022 | 0.009 | 1.5 | 0.007 | 0.0025 | 0.02 | 0.0032 |
| Q | 0.024 | 0.01 | 1.0 | 0.004 | 0.0025 | 0.032 | 0.0031 |
| R | 0.036 | 0.015 | 1.1 | 0.002 | 0.0020 | 0.050 | 0.0024 |

| Steel No. | Ti | Nb | Ti/C | Others | Note |
|---|---|---|---|---|---|
| A | 0.064 | — | 3.20 | — | Inventive example |
| B | 0.08 | — | 3.08 | — | Inventive example |
| C | 0.104 | 0.006 | 3.06 | Ca = 0.003 | Comparative example |
| D | 0.065 | — | 2.60 | — | Inventive example |
| E | 0.095 | — | 3.39 | — | Inventive example |
| F | 0.076 | — | 2.53 | Ce = 0.020 | Inventive example |
| G | 0.104 | — | 3.59 | — | Comparative example |
| H | 0.126 | — | 4.50 | — | Comparative example |
| I | 0.077 | | 4.53 | — | Comparative example |
| J | 0.068 | 0.01 | 1.42 | — | Comparative example |
| K | 0.082 | — | 3.28 | — | Comparative example |
| L | 0.067 | 0.004 | 3.35 | Cr = 0.3 | Comparative example |
| M | 0.071 | | 2.54 | B = 0.0012, Cu = 0.28, Ni = 0.18 | Comparative example |
| N | 0.063 | | 3.32 | V = 0.03 | Comparative example |
| O | 0.097 | | 2.62 | W = 0.12, Ca = 0.0023 | Comparative example |
| P | 0.075 | | 3.41 | Mo = 0.28 | Comparative example |
| Q | 0.053 | | 2.21 | Cr = 0.25 | Comparative example |
| R | 0.075 | 0.003 | 2.08 | B = 0.0004 | Comparative example |

TABLE 2

| Steel No. | SRT (° C.) | Heating of rough bar | RT (° C.) | FT (° C.) | Time period up to start of cooling (second) | Average cooling rate in temperature range of 750° C. to 600° C. (° C./sec) | CT (° C.) | Note |
|---|---|---|---|---|---|---|---|---|
| A-1 | 1200 | None | 1050 | 930 | 1.6 | 30 | 500 | Inventive example |
| A-2 | 1200 | None | 1050 | 920 | 1.6 | 15 | 600 | Comparative example |
| B-1 | 1220 | None | 1080 | 890 | 2.2 | 25 | 500 | Inventive example |
| B-2 | 1220 | None | 1080 | 890 | 2.2 | 8 | 500 | Comparative example |
| C-1 | 1240 | Heated | 1080 | 890 | 0.3 | 35 | 520 | Comparative example |
| C-2 | 1240 | Heated | 1080 | 905 | 2.0 | 20 | 520 | Comparative example |
| D-1 | 1070 | None | 960 | 835 | 1.8 | 30 | 490 | Comparative example |
| D-2 | 1180 | None | 1030 | 885 | 1.8 | 30 | 490 | Inventive example |

TABLE 2-continued

| Steel No. | SRT (° C.) | Heating of rough bar | RT (° C.) | FT (° C.) | Time period up to start of cooling (second) | Average cooling rate in temperature range of 750° C. to 600° C. (° C./sec) | CT (° C.) | Note |
|---|---|---|---|---|---|---|---|---|
| D-3 | 1250 | None | 1060 | 890 | 1.8 | 30 | 490 | Inventive example |
| E-1 | 1230 | None | 1100 | 910 | 4.6 | 20 | 510 | Inventive example |
| E-2 | 1230 | None | 1100 | 910 | 1.7 | 50 | 400 | Comparative example |
| E-3 | 1230 | None | 1100 | 910 | 1.7 | 50 | 450 | Comparative example |
| F-1 | 1220 | Heated | 1040 | 900 | 2.2 | 30 | 480 | Inventive example |
| F-2 | 1220 | None | 1040 | 900 | 2.2 | 20 | 540 | Inventive example |
| F-3 | 1220 | None | 1040 | 900 | 0.4 | 7 | 640 | Comparative example |
| G-1 | 1230 | Heated | 1050 | 910 | 1.2 | 20 | 500 | Comparative example |
| G-2 | 1230 | Heated | 1050 | 910 | 1.2 | 5 | 500 | Comparative example |

TABLE 3

| Steel No. | SRT (° C.) | Heating of rough bar | RT (° C.) | FT (° C.) | Time period up to start of cooling (second) | Average cooling rate in temperature range of 750° C. to 600° C. (° C./sec) | CT (° C.) | Note |
|---|---|---|---|---|---|---|---|---|
| H-1 | 1190 | None | 1020 | 890 | 0.4 | 25 | 510 | Comparative example |
| H-2 | 1220 | None | 1030 | 890 | 1.5 | 25 | 520 | Comparative example |
| I-1 | 1150 | Heated | 1010 | 885 | 2.0 | 30 | 530 | Comparative example |
| I-2 | 1150 | None | 950 | 855 | 2.0 | 30 | 530 | Comparative example |
| J-1 | 1210 | Heated | 1060 | 920 | 1.5 | 25 | 500 | Comparative example |
| J-2 | 1210 | None | 1060 | 915 | 1.6 | 30 | 530 | Comparative example |
| K-1 | 1220 | None | 1070 | 900 | 2.2 | 30 | 500 | Comparative example |
| K-2 | 1220 | None | 1060 | 900 | 2.2 | 20 | 500 | Comparative example |
| L-1 | 1200 | None | 1050 | 900 | 2.8 | 38 | 550 | Comparative example |
| M-1 | 1200 | None | 1050 | 900 | 3.0 | 35 | 520 | Comparative example |
| N-1 | 1200 | None | 1040 | 900 | 2.5 | 13 | 480 | Comparative example |
| O-1 | 1200 | None | 1040 | 900 | 1.8 | 24 | 450 | Comparative example |
| P-1 | 1200 | None | 1040 | 900 | 3.2 | 39 | 500 | Comparative example |
| Q-1 | 1200 | None | 1050 | 900 | 2.5 | 35 | 550 | Comparative example |
| R-1 | 1200 | None | 1020 | 900 | 3.3 | 33 | 530 | Comparative example |

The chemical compositions in Table 1 are expressed by mass %. The steels D, O and P were subjected to descaling after the rough rolling under conditions where an impingement pressure was 2.7 MP and a flow rate was 0.001 liter/cm$^2$. The steel I shown in Table 1 was subjected to zinc plating (galvanizing) at 450° C.

The detailed manufacturing conditions are shown in Tables 2 and 3.

Herein, the chemical composition of a steel in Tables 2 and 3 corresponds to the chemical composition of a steel of Table 1 which has the same alphabet steel number. "SRT" indicates a slab extraction temperature. "Heating of rough bar" indicates whether a rough bar or a rolled steel is heated during the period of the end of the rough rolling to the start of the finish rolling and/or during the finish rolling. "RT" indicates the end temperature of the rough rolling. "FT" indicates the end temperature of the finish rolling. "Time period up to start of cooling" indicates a time period from the end of the finish rolling to the start of the cooling. "Cooling rate in temperature range of 750° C. to 600° C." indicates an average cooling rate when passing through a temperature range of 750° C. to 600° C. during the cooling. "CT" indicates the coiling temperature.

The evaluation results of the obtained thin steel sheet are shown in Tables 4 and 5.

TABLE 4

| Steel No. | TS (MPa) | YS (MPa) | El (%) | AI (MPa) | λ (%) | λ × El | Fatigue limit (MPa) | Ferrite volume fraction (%) | Punched fracture surface | Piercing fatigue limit (MPa) | Note |
|---|---|---|---|---|---|---|---|---|---|---|---|
| A-1 | 554 | 489 | 34 | 36 | 187 | 6358 | 203 | 100 | A | 200 | Inventive example |
| A-2 | 570 | 532 | 30 | 9 | 116 | 3480 | 193 | 100 | C | 165 | Comparative example |
| B-1 | 595 | 530 | 29 | 29 | 156 | 4524 | 224 | 100 | A | 205 | Inventive example |
| B-2 | 546 | 464 | 31 | 14 | 75 | 2325 | 208 | 100 | B | 180 | Comparative example |
| C-1 | 658 | 594 | 26 | 20 | 60 | 1560 | 235 | 98 | C | 185 | Comparative example |
| C-2 | 643 | 571 | 26 | 22 | 149 | 3874 | 239 | 99 | C | 180 | Comparative example |
| D-1 | 476 | 318 | 33 | 3 | 88 | 2904 | 156 | 99 | C | 130 | Comparative example |
| D-2 | 605 | 513 | 29 | 34 | 152 | 4408 | 222 | 99 | A | 205 | Inventive example |
| D-3 | 609 | 521 | 30 | 39 | 173 | 5190 | 223 | 99 | A | 210 | Inventive example |
| E-1 | 602 | 537 | 30 | 26 | 164 | 4920 | 230 | 100 | A | 200 | Inventive example |
| E-2 | 577 | 540 | 18 | 20 | 110 | 1980 | 215 | 18 | A | 200 | Comparative example |
| E-3 | 500 | 470 | 18 | 20 | 125 | 2250 | 215 | 18 | A | 200 | Comparative example |
| F-1 | 599 | 519 | 29 | 32 | 176 | 5104 | 238 | 100 | A | 225 | Inventive example |
| F-2 | 611 | 521 | 28 | 29 | 186 | 5208 | 240 | 100 | A | 225 | Inventive example |
| F-3 | 625 | 548 | 24 | 11 | 45 | 1080 | 235 | 100 | C | 185 | Comparative example |

TABLE 4-continued

| Steel No. | TS (MPa) | YS (MPa) | El (%) | AI (MPa) | λ (%) | λ × El | Fatigue limit (MPa) | Ferrite volume fraction (%) | Punched fracture surface | Piercing fatigue limit (MPa) | Note |
|---|---|---|---|---|---|---|---|---|---|---|---|
| G-1 | 648 | 520 | 23 | 8 | 94 | 2162 | 229 | 100 | C | 180 | Comparative example |
| G-2 | 607 | 463 | 25 | 4 | 71 | 1775 | 220 | 100 | C | 170 | Comparative example |

TABLE 5

| Steel No. | TS (MPa) | YS (MPa) | El (%) | AI (MPa) | λ (%) | λ × El | Fatigue limit (MPa) | Ferrite volume fraction (%) | Punched fracture surface | Piercing fatigue limit (MPa) | Note |
|---|---|---|---|---|---|---|---|---|---|---|---|
| H-1 | 660 | 497 | 21 | 3 | 42 | 882 | 240 | 99 | C | 190 | Comparative example |
| H-2 | 654 | 456 | 23 | 2 | 59 | 1357 | 228 | 99 | C | 180 | Comparative example |
| I-1 | 632 | 444 | 23 | 0 | 84 | 1932 | 218 | 100 | C | 170 | Comparative example |
| I-2 | 584 | 429 | 25 | 0 | 80 | 2000 | 214 | 100 | C | 165 | Comparative example |
| J-1 | 500 | 410 | 26 | 46 | 75 | 1950 | 207 | 99 | C | 160 | Comparative example |
| J-2 | 500 | 410 | 26 | 45 | 71 | 1846 | 205 | 99 | C | 155 | Comparative example |
| K-1 | 594 | 554 | 29 | 23 | 146 | 4234 | 195 | 100 | A | 175 | Comparative example |
| K-2 | 600 | 565 | 28 | 26 | 154 | 4312 | 198 | 100 | A | 180 | Comparative example |
| L-1 | 623 | 590 | 25 | 20 | 142 | 3550 | 235 | 99 | C | 180 | Comparative example |
| M-1 | 654 | 613 | 24 | 22 | 142 | 3408 | 240 | 99 | B | 190 | Comparative example |
| N-1 | 603 | 527 | 28 | 25 | 141 | 3948 | 235 | 99 | C | 180 | Comparative example |
| O-1 | 647 | 530 | 26 | 20 | 155 | 4030 | 255 | 99 | B | 190 | Comparative example |
| P-1 | 645 | 621 | 25 | 19 | 150 | 3750 | 245 | 99 | C | 180 | Comparative example |
| Q-1 | 577 | 522 | 28 | 16 | 144 | 4032 | 235 | 98 | B | 180 | Comparative example |
| R-1 | 584 | 505 | 27 | 20 | 150 | 4050 | 215 | 98 | C | 170 | Comparative example |

For a tensile test, at first, test materials were processed into No. 5-test pieces described in JIS Z 2201, and the test was performed in accordance with a test method described in JIS Z 2241.

For an AI test, test materials were processed into No. 5-test pieces described in JIS Z 2201 as in the tensile test. Tensile pre-strain of 7% was applied to the test pieces. Then, they were subjected to a heat treatment at 100° C. for 60 minutes. Thereafter, a tensile test was performed once again. Herein, AI (aging index) is defined as a value which is obtained by deducting a flow stress at a tensile pre-strain of 10% from the upper yield point in the re- tensile testing.

Stretch-flange formability was evaluated by a hole expansion value (rate) measured in accordance with a hole expansion testing method described in Japan Iron and Steel Federation Standard JFS T 1001-1996.

In Table 2, "TS" indicates a maximum tensile strength, "YS" indicates a yield strength, "El" indicates an elongation, "AI" indicates an aging index, and "X" indicates a hole expansion ratio.

Fatigue properties were evaluated by a complete both vibrating and bending test in accordance with JIS Z 2275. A test shape was processed in accordance with JIS Z 2275. The upper limit of fatigue strength at $1\times10^7$ repetitions was defined as the fatigue limit.

In some cases, depending on the test time, the fatigue test is terminated at $1\times10^6$ repetitions or $2\times10^6$ repetitions. However, in this case, the fatigue limit becomes higher than that in the case of $1\times10^7$ repetitions.

The microstructure was examined as follows. The end faces of samples, which were cut out from the ¼ W or ¾ W position of the width of the steel sheet, were polished in a rolling direction, and then etching was performed thereon by using a nitral reagent. They were observed by using an optical microscope at 200 to 500-fold magnification, and photographs of a field of view at ¼ t of the sheet thickness were taken to examine the microstructure. The volume fraction of the microstructure is defined by the area fraction in the metal microstructure photograph. The steel sheet of the present invention is mainly composed of PF and αq. The total of the volume fractions of PF and αq is the ferrite volume fraction.

αq is one of microstructures which are defined as transformation microstructures at an intermediate stage between polygonal ferrite and non-diffusion martensite formed by a diffusional mechanism, as disclosed in "Recent Research on the Bainite Microstructure of Low Carbon Steel and its Transformation Behavior-Final Report of the Bainite Research Committee", edited by the Bainite Investigation and Research Committee of the Basic Research Group of the Iron and Steel Institute of Japan (1994, The Iron and Steel Institute of Japan). Regarding αq, the inner microstructure does not appear by etching as in PF. However, the configuration is that of divided acicular, and αq is clearly distinguished from PF. Herein, when the peripheral length of target crystal grains is denoted by lq, and the equivalent circle diameter thereof is denoted by dq, grains satisfying the ratio (lq/dq) of 3.5 or more are αq.

A punched fracture surface was evaluated as follows. Shear cutting was performed on the steel sheet at a clearance of 12% of the sheet thickness and the obtained punched end face (the characteristics of a fracture surface of the punched portion, and fracture surface) was observed by a microscope. The area ratio of an abnormal fracture surface other than a ductile fracture surface in the punched end face was measured and evaluated as follows.

A (good): Area ratio of abnormal fracture surface is in a range of less than 5%

B (fair): Area ratio of abnormal fracture surface is in a range of 5% or more to less than 20%

C (bad): Area ratio of abnormal fracture surface is in a range of 20% or more

Herein, a surface on which dimples, which are typical configurations of the ductile fracture surface, are not observed by a microscope is defined as a brittle fracture surface. A cleavage fracture surface, a grain-boundary fracture surface and an interfacial fracture surface are classified as brittle fracture surfaces. The abnormal fracture surface is a brittle fracture surface in which no dimples are observed when being viewed by a microscope, and is a cleavage fracture surface or a grain-boundary fracture surface.

A fatigue test was performed on the piercing-punched members as follows.

Punched holes with a punch diameter Φ of 10 mm were formed at a clearance of 12% in the center of a fatigue test piece. As in the case of fatigue properties, a complete both vibrating and bending fatigue test (stress ratio R=−1) with a constant stress amplitude was performed and the upper limit of fatigue strength at $1\times10^7$ repetitions was measured as a piercing fatigue limit.

The results of Tables 2 to 5 are put together as follows.

The steels A-1, B-1, D-2, D-3, E-1, F-1 and F-2 are examples of the present invention.

In the steel A-2, because of its high CT, the amount of TiC precipitates increased; and thereby, a brittle fracture surface was formed.

In the steel B-2, because of a low cooling rate after the finish rolling, the amount of TiC precipitates increased; and thereby, a brittle fracture surface was formed.

In the steel C-1, because of the precipitation of NbC, a brittle fracture surface was formed.

In the steel C-2, because of the precipitation of NbC, a brittle fracture surface was formed.

In the steel D-1, because Ti-based carbides were not solid-solubilized sufficiently, the amount of TiC precipitates increased; and thereby a brittle fracture surface was formed.

In the steel E-2, because of its low CT, the elongation was decreased.

In the steel E-3, because of a high cooling rate, precipitates were not precipitated and bainite was formed; and thereby, the strength was decreased.

In the steel F-3, because of its high CT, the amount of TiC increased; and thereby, a brittle fracture surface was formed.

In the steel G-1, because of its high Ti/C, the amount of TiC precipitates increased; and thereby, the hole expansionability deteriorated and a brittle fracture surface was formed.

In the steel G-2, because of its high Ti/C, the amount of TiC precipitates increased; and thereby, the hole expansionability deteriorated and a brittle fracture surface was formed.

In the steel H-1, because of a high Ti content, the amount of TiC precipitates increased; and thereby, the hole expansionability deteriorated and a brittle fracture surface was formed.

In the steel H-2, the amount of TiC precipitates increased; and thereby, the hole expansionability deteriorated and a brittle fracture surface was formed.

In the steel I-1, because of a low C content, Ti—C clusters were not formed.

In the steel I-2, because of a low C content, Ti—C clusters were not formed.

In the steel J-1, because of its low Ti/C, a microstructure consisting of polygonal ferrite was obtained; and thereby, the strength was decreased and a brittle fracture surface was also formed.

In the steel J-2, because of its low Ti/C, a microstructure consisting of polygonal ferrite was obtained; and thereby, the strength was decreased and a brittle fracture surface was also formed.

In the steel K-1, because of a high Si content, a fatigue limit was lowered.

In the steel K-2, because of a high Si content, a fatigue limit was lowered.

In the steel L-1, because of the formation of Cr carbides, a brittle fracture surface was formed.

In the steel M-1, because of the formation of B carbides, a brittle fracture surface was formed.

In the steel N-1, because of the formation of V carbides, a fatigue limit was lowered.

In the steel O-1, because of the formation of W carbides, a brittle fracture surface was formed.

In the steel P-1, because of the formation of Mo carbides, a brittle fracture surface was formed.

In the steel Q-1, because of the formation of Cr carbides, a brittle fracture surface was formed.

In the steel R-1, because of the formation of B carbides, a brittle fracture surface was formed.

Tables 6 and 7 show examples in which the hot-rolled steel sheets obtained under the following conditions were subjected to acid washing and then subjected to annealing or zinc plating.

Hot rolling conditions: a slab was re-heated at 1200° C.; the finish rolling temperature was 900° C.; the time period up to the start of the cooling was 2 sec; the average cooling rate in a temperature range of 750° C. to 600° C. was 35° C./sec; and the winding temperature was 530° C.

The steels A-3 and A-4 are examples in which only annealing was performed by a box annealing furnace.

The steels B-3 and B-4 are examples in which an annealing and a subsequent zinc plating were performed by continuous annealing and plating facilities.

The steels C-3, C-4, D-3, E-3,F-3, L-2 and L-3 are examples in which an annealing, a subsequent zinc plating, and a plating alloying process were performed by continuous annealing and plating facilities.

The steels M-2 and N-2 are examples in which an acid-washed sheet was heated up to a zinc plating temperature, and then a zinc plating and a plating alloying process were performed.

Here, the zinc plating dipping temperature was 450° C., and the plating alloying temperature was 500° C.

TABLE 6

| Steel No. | Annealing condition | TS (MPa) | YS (MPa) | El (%) | AI (MPa) | λ (%) | λ × El | Fatigue limit (MPa) | Ferrite volume fraction (%) | | Note |
|---|---|---|---|---|---|---|---|---|---|---|---|
| A-3 | 610° C. × 40 min | 665 | 650 | 24 | 20 | 142 | 3408 | 245 | 98 | Annealing only | Inventive example |
| A-4 | 785° C. × 40 min | 380 | 355 | 33 | 13 | 177 | 5841 | 165 | 95 | Annealing only | Comparative example |
| B-3 | 630° C. × 30 s | 640 | 603 | 26 | 18 | 134 | 3484 | 220 | 98 | Annealing-zinc plating | Inventive example |

TABLE 6-continued

| Steel No. | Annealing condition | TS (MPa) | YS (MPa) | El (%) | AI (MPa) | λ (%) | λ × El | Fatigue limit (MPa) | Ferrite volume fraction (%) | | Note |
|---|---|---|---|---|---|---|---|---|---|---|---|
| B-4 | 790° C. × 30 s | 550 | 524 | 25 | 20 | 86 | 2150 | 195 | 91 | Annealing-zinc plating | Comparative example |
| C-3 | 600° C. × 50 s | 655 | 642 | 25 | 18 | 140 | 3500 | 235 | 99 | Annealing-zinc plating-plating alloying | Comparative example |
| C-4 | 800° C. × 50 s | 515 | 490 | 28 | 22 | 78 | 2184 | 195 | 88 | Annealing-zinc plating-plating alloying | Comparative example |
| D-3 | 700° C. × 30 s | 645 | 590 | 23 | 34 | 124 | 2852 | 240 | 99 | Annealing-zinc plating-plating alloying | Inventive example |
| E-3 | 650° C. × 30 s | 652 | 617 | 25 | 26 | 138 | 3450 | 250 | 100 | Annealing-zinc plating-plating alloying | Inventive example |
| F-3 | 600° C. × 30s | 643 | 619 | 29 | 32 | 145 | 4205 | 235 | 100 | Annealing-zinc plating-plating alloying | Inventive example |
| L-2 | 690° C. × 20 s | 646 | 633 | 25 | 25 | 102 | 2550 | 225 | 100 | Annealing-zinc plating-plating alloying | Comparative example |
| L-3 | 840° C. × 20 s | 499 | 462 | 24 | 22 | 89 | 2136 | 205 | 81 | Annealing-zinc plating-plating alloying | Comparative example |
| M-2 | | 656 | 633 | 24 | 20 | 128 | 3072 | 240 | 99 | Zinc plating | Comparative example |
| N-2 | | 605 | 567 | 28 | 22 | 123 | 3444 | 240 | 99 | Zinc plating-plating alloying | Comparative example |
| Q-2 | 680° C. × 60 s | 625 | 593 | 26 | 20 | 124 | 3224 | 235 | 98 | Annealing-zinc plating-plating alloying | Comparative example |
| Q-3 | | 601 | 570 | 25 | 16 | 137 | 3425 | 250 | 98 | Zinc plating-plating alloying | Comparative example |
| R-2 | 620° C. × 60 s | 615 | 582 | 26 | 17 | 120 | 3120 | 245 | 98 | Annealing-zinc plating-plating alloying | Comparative example |
| R-3 | | 595 | 572 | 26 | 18 | 119 | 3094 | 235 | 98 | Zinc plating-plating alloying | Comparative example |

TABLE 7

| Steel No. | Punched fracture surface | Piercing (MPa) | Note |
|---|---|---|---|
| A-3 | A | 230 | Inventive example |
| A-4 | B | 130 | Comparative example |
| B-3 | A | 205 | Inventive example |
| B-4 | B | 175 | Comparative example |
| C-3 | C | 180 | Comparative example |
| C-4 | C | 150 | Comparative example |
| D-3 | A | 225 | Inventive example |
| E-3 | B | 195 | Inventive example |
| F-3 | A | 225 | Inventive example |
| L-2 | C | 180 | Comparative example |
| L-3 | C | 160 | Comparative example |
| M-2 | B | 195 | Comparative example |
| N-2 | C | 180 | Comparative example |
| Q-2 | C | 180 | Comparative example |
| Q-3 | C | 180 | Comparative example |
| R-2 | C | 180 | Comparative example |
| R-3 | C | 180 | Comparative example |

In the examples of the present invention, a hot-rolled steel sheet is obtained, which contains predetermined amounts of steel components, has a microstructure mainly composed of uniform ferrite and has both fatigue properties and stretch-flange formability. That is, a hole expansion value which is evaluated by the method described in the present invention exceeds 140%.

Regarding the results of fatigue properties (fatigue limit), the fatigue strength is also excellent in the examples of the present invention as shown in Tables 2 to 7.

In the comparative examples, chemical components and/or a manufacturing method are beyond the scope of the present invention, and as a result, it is found that strength, hole expansionability, fatigue properties and the like are deteriorated.

In Tables 2 to 5, in the steels K-1 and K-2 including components which are beyond the scope of the present invention, the fatigue limit is in a range of 200 or less; and therefore, these steels are beyond the scope of the present invention.

Industrial Applicability

The hot-rolled steel sheet of the present invention is suitably used in, particularly, a vehicle chassis and an underbody component, and is most suitably used in a wheel disk. Since the hot-rolled steel sheet is excellent in formability including stretch-flange formability, a degree of freedom of design is increased; and therefore, a so-called high-design-property wheel is realized. In addition, since the occurrence of brittle fracture in a punched end face (shear cutting fracture surface) when a hole is punched is suppressed, fatigue failure can be effectively suppressed, and excellent fatigue properties (piercing fatigue properties) can be achieved. Moreover, since the hot-rolled steel sheet is excellent in corrosion resistance after coating and has a high strength, the sheet thickness can be decreased. Therefore, the hot-rolled steel sheet contributes to the preservation of the environment through the decrease in the weight of the vehicle body.

The invention claimed is:

1. A hot-rolled steel sheet, comprising: in terms of mass %,
C: 0.015% or more to less than 0.035%;
Si: less than 0.05%;
Mn: 0.9% or more to 1.8% or less;
P: less than 0.02%;
S: less than 0.01%;
Al: less than 0.1%;
N: less than 0.006%;
Ti: 0.05% or more to less than 0.11%; and
either one or both of Cu: 0.01% or more to 1.5% or less and Ni: 0.01% or more to 0.8% or less,
with the remainder being Fe and inevitable impurities,
wherein Ti/C is in a range of 2.5 or more to less than 3.5,
Nb, Zr, V, Cr, Mo, B and W are not included, a microstructure comprises a mixed microstructure of polygonal ferrite and quasi-polygonal ferrite in a proportion of greater than 96%, martensite and residual austenite are not included, a maximum tensile strength is in a range of 520 MPa or more to less than 720 MPa, an aging index AI is in a range of more than 15 MPa, a product of a hole expansion ratio (λ) % and a total elongation (El) % is in a range of 2350 or more, and a fatigue limit is in a range of 200 MPa or more.

2. The hot-rolled steel sheet according to claim 1, wherein the hot-rolled steel sheet further comprises, in terms of mass %, either one or both of Ca: 0.0005% or more to 0.005% or less and REM: 0.0005% or more to 0.05% or less.

3. The hot-rolled steel sheet according to claim 1, wherein the hot-rolled steel sheet is treated with plating.

4. A method for manufacturing a hot-rolled steel sheet, the method comprising:

heating a slab at a temperature within a range of 1100° C. or higher, wherein the slab contains: in terms of mass %, C: 0.015% or more to less than 0.035%; Si: less than 0.05%; Mn: 0.9% or more to 1.8% or less; P: less than 0.02%; S: less than 0.01%; Al: less than 0.1%; N: less than 0.006%; Ti: 0.05% or more to less than 0.11%; and either one or both of Cu: 0.01% or more to 1.5% or less and Ni: 0.01% or more to 0.8% or less, with the remainder being Fe and inevitable impurities, in which Ti/C is in a range of 2.5 or more to less than 3.5, and Nb, Zr, V, Cr, Mo, B and W are not contained, and subjecting the slab to a rough rolling under conditions where the rough rolling is completed at a temperature within a range of 1000° C. or higher so as to obtain a rough bar;

subjecting the rough bar to a finish rolling under conditions where the finish rolling is completed at a temperature within a range of 830° C. to 980° C. so as to obtain a rolled steel;

performing an air-cooling for 0.5 seconds or longer after the finish rolling, and subsequently performing cooling at an average cooling rate within a range of 10° C./sec to 40° C./sec in a temperature range of 750° C. to 600° C. under conditions where a time period during which a temperature reaches 700° C. from an end of the finish rolling is in a range of 5 to 20seconds so as to obtain a hot-rolled steel sheet; and coiling the hot-rolled steel sheet at a temperature within a range of 440° C. to 560° C., wherein the hot-rolled steel sheet is manufactured in which a microstructure comprises a mixed structure of polygonal ferrite and quasi-polygonal ferrite in a proportion of greater than 96%, martensite and residual austenite are not included, a maximum tensile strength is in a range of 520 MPa or more to less than 720 MPa, an aging index AI is in a range of 15 MPa or more, a product of a hole expansion ratio (λ) % and total elongation (El) % is in a range of 2350 or more, and a fatigue limit is in a range of 200 MPa or more.

5. The method for manufacturing a hot-rolled steel sheet according to claim 4, wherein the rough bar or the rolled steel is heated during a period until a start of the subjecting of the rough bar to the finish rolling and/or during the subjecting of the rough bar to the finish rolling.

6. The method for manufacturing a hot-rolled steel sheet according to claim 4, wherein descaling is performed between an end of the subjecting of the slab to the rough rolling and a start of the subjecting of the rough bar to the finish rolling.

7. The method for manufacturing a hot-rolled steel sheet according to claim 4, wherein the method further comprises subjecting the hot-rolled steel sheet to annealing at a temperature within a range of 780° C. or lower.

8. The method for manufacturing a hot-rolled steel sheet according to claim 4, wherein the method further comprises heating the hot-rolled steel sheet at a temperature within a range of 780° C. or lower, and then dipping the hot-rolled steel sheet in a plating bath so as to plate surfaces of the hot-rolled steel sheet.

9. The method for manufacturing a hot-rolled steel sheet according to claim 8, wherein the method further comprises performing an alloying treatment after the plating.

* * * * *